US009016248B2

(12) United States Patent
Burgard et al.

(10) Patent No.: US 9,016,248 B2
(45) Date of Patent: Apr. 28, 2015

(54) FIXING DEVICE FOR ATTACHING A CYLINDER BLOCK TO AN ENGINE BLOCK OF A TWO-STROKE ENGINE

(75) Inventors: Michael Burgard, Petite-Rosselle (FR); Alexander Burgard, Saarbrücken (DE)

(73) Assignee: Maxiscoot GmbH, Saarbrucken (DE)

( * ) Notice: Subject to any disclaimer, the term of this patent is extended or adjusted under 35 U.S.C. 154(b) by 593 days.

(21) Appl. No.: 13/351,430

(22) Filed: Jan. 17, 2012

(65) Prior Publication Data

US 2013/0092137 A1 Apr. 18, 2013

(30) Foreign Application Priority Data

Oct. 12, 2011 (DE) ..... 10 2011 054 445

(51) Int. Cl.

| | |
|---|---|
| ***F02F 1/22*** | (2006.01) |
| ***F02B 25/00*** | (2006.01) |
| ***F02B 25/14*** | (2006.01) |
| *F02B 75/02* | (2006.01) |

(52) U.S. Cl.

CPC . *F02B 25/00* (2013.01); *F02F 1/22* (2013.01); *F02B 2075/025* (2013.01); *F02B 25/14* (2013.01)

(58) Field of Classification Search

USPC ... 123/195 R, 65 R, 73 R, 65 PE, 65 A, 65 P; 29/888.01, 888.011

See application file for complete search history.

(56) References Cited

FOREIGN PATENT DOCUMENTS

JP 11022471 A * 1/1999

* cited by examiner

*Primary Examiner* — Lindsay Low
*Assistant Examiner* — Kevin Lathers
(74) *Attorney, Agent, or Firm* — Stein IP, LLC

(57) ABSTRACT

A two-stroke engine includes a crankcase, a cylinder block; a combustion chamber with an outlet port, wherein the combustion chamber is formed in a cylinder running surface; and a cylinder head, which closes the cylinder block at an end of the combustion chamber, wherein: at least one transfer port is formed in the cylinder in order to connect an interior space of the crankcase with the combustion chamber, the cylinder block comprises at least one axial bore, at least partially penetrated in a wall of the outlet port and/or of the transfer port, so that the bore at least partially forms an opening at the wall side in the outlet port and/or in the transfer port, and a pin is in the at least one bore and closes the at least one opening at the wall side wherein a portion of a surface of the wall of the outlet port and/or of the transfer port penetrated by the bore is substantially restored in the area of the opening at the wall side with a portion of the pin, the pin is substantially cylindrical and comprises a rim side cut-out, and a surface of the rim side cut-out substantially corresponds to the portion of the surface of the wall of the outlet port and/or of the transfer port in the area of the opening at the wall side.

9 Claims, 7 Drawing Sheets

FIXING DEVICE FOR ATTACHING A CYLINDER BLOCK TO AN ENGINE BLOCK OF A TWO-STROKE ENGINE

CROSS-REFERENCE TO RELATED APPLICATION

This application claims the benefit of German Application No. 10-2011-054-445.3, filed Oct. 12, 2011 in the German Patent and Trademark Office, the disclosure of which is incorporated herein by reference.

BACKGROUND OF THE INVENTION

1. Field of the Invention

Aspects of the present invention relate to a two-stroke engine with a cylinder block and with a cylinder head, wherein the cylinder head closes the cylinder block at an end of a combustion chamber, wherein the combustion chamber comprises an outlet port, wherein at least one transfer port is formed in the cylinder block and wherein the cylinder block is attached to a engine block or to a crankcase of the two-stroke engine using a fixing mechanism or system.

2. Description of the Related Art

Two-stroke engines comprise one or more outlet ports and a number of transfer ports, which are arranged around a cylinder running surface of a cylinder block. The transfer ports connect the combustion chamber in the cylinder block with a crankcase, to which the cylinder is attached.

Conventional two-stroke engines attach cylinder blocks to an engine block or to the crankcase using through stud bolts. Since the stud bolts are normally arranged very close to the cylinder running surface, the possibilities of shaping the different ports, particularly the transfer ports, are very limited, since the position and the size of the stud bolts must be considered when designing the ports. Particularly, in case of tuning cylinder blocks, the possibility of shaping the ports differently is even more limited, since in most cases, the tuning cylinder blocks have a considerably larger bore than the original (i.e., non-tuned) cylinder block and the tuning cylinder blocks are still to be attached to the crankcase with the existing stud bolts.

An individual tuning cylinder block is developed for every type of engine in the area of engine tuning comprising the required performance, which is also achieved using larger ports, particularly transfer ports, and which can be attached to existing stud bolt holes in order to overcome these disadvantages.

When developing the tuning cylinder blocks for the respective types of engines, the size and the position of the stud bolts must still be considered. The disadvantage is that a tuning cylinder block which is especially developed for one type of engine can only be used for this type of engine. Using a tuning cylinder block for different types of engines is only possible in exceptional cases, namely, when the types of engines are very similar. Generally, it is necessary to develop an individual tuning cylinder block for every type of engine, which means high development effort and different manufacturing processes.

SUMMARY OF THE INVENTION

Aspects of the invention provide solutions to enable attaching a cylinder block to an engine housing or to a crankcase of different types of engines, without having to put up with the disadvantages of the prior art, particularly as far as the embodiment of the outlet ports is concerned.

An aspect of present invention includes a two-stroke engine according to the independent claim. Advantageous embodiments of the invention are referred to in the respective dependent claims and/or as described in the specification.

An aspect of present invention provides a crankcase, a cylinder block; a combustion chamber with an outlet port, wherein the combustion chamber is formed in a cylinder running surface; and a cylinder head, which closes the cylinder block at an end of the combustion chamber, wherein: at least one transfer port is formed in the cylinder in order to connect an interior space of the crankcase with the combustion chamber, the cylinder block comprises at least one axial bore, at least partially penetrated in a wall of the outlet port and/or of the transfer port, so that the bore at least partially forms an opening at the wall side in the outlet port and/or in the transfer port, and a pin is in the at least one bore and closes the at least one opening at the wall side wherein a portion of a surface of the wall of the outlet port and/or of the transfer port penetrated by the bore is substantially restored in the area of the opening at the wall side with a portion of the pin, the pin is substantially cylindrical and comprises a rim side cut-out, and a surface of the rim side cut-out substantially corresponds to the portion of the surface of the wall of the outlet port and/or of the transfer port in the area of the opening at the wall side.

According to an aspect of present invention, bores can be advantageously made parallel to the longitudinal axis of the cylinder, regardless of whether the bores penetrate the ports (outlet port and/or transfer ports) or not.

According to an embodiment of the invention, the pin can be formed in two parts, wherein a lower boundary surface of the upper part of the pin closes a first opening at the wall side of the outlet port and/or of the transfer port, and wherein an upper boundary surface of the lower part of the pin closes a second opening at the wall side of the outlet port and/or of the transfer port.

According to an aspect of present invention, a lower section of the bore facing the crankcase can have a smaller diameter than the upper section of the bore, wherein lower fixing means can be arranged in the lower section of the bore in order to attach the cylinder to the crankcase.

According to an aspect of present invention, the upper part of the pin is attached to the cylinder head using an upper fixing mechanism can be attached to the cylinder head, preferably with upper fixing means.

According to an aspect of present invention, the upper end of the upper part of the pin can comprise a blind hole as holder for the upper fixing means.

According to an aspect of present invention, the pin comprises at least one radial cut-out as holder for an o-ring.

According to an aspect of present invention, an upper section of the pin at least partially extends into a deepening at the bottom side of the cylinder head, corresponding with the upper section of the pin.

According to an aspect of present invention, the upper section of the pin comprises a lock against rotation, which extends into a cut-out in the deepening corresponding with the lock against rotation.

According to an aspect of present invention, the lock against rotation can comprise a needle of a needle roller bearing.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
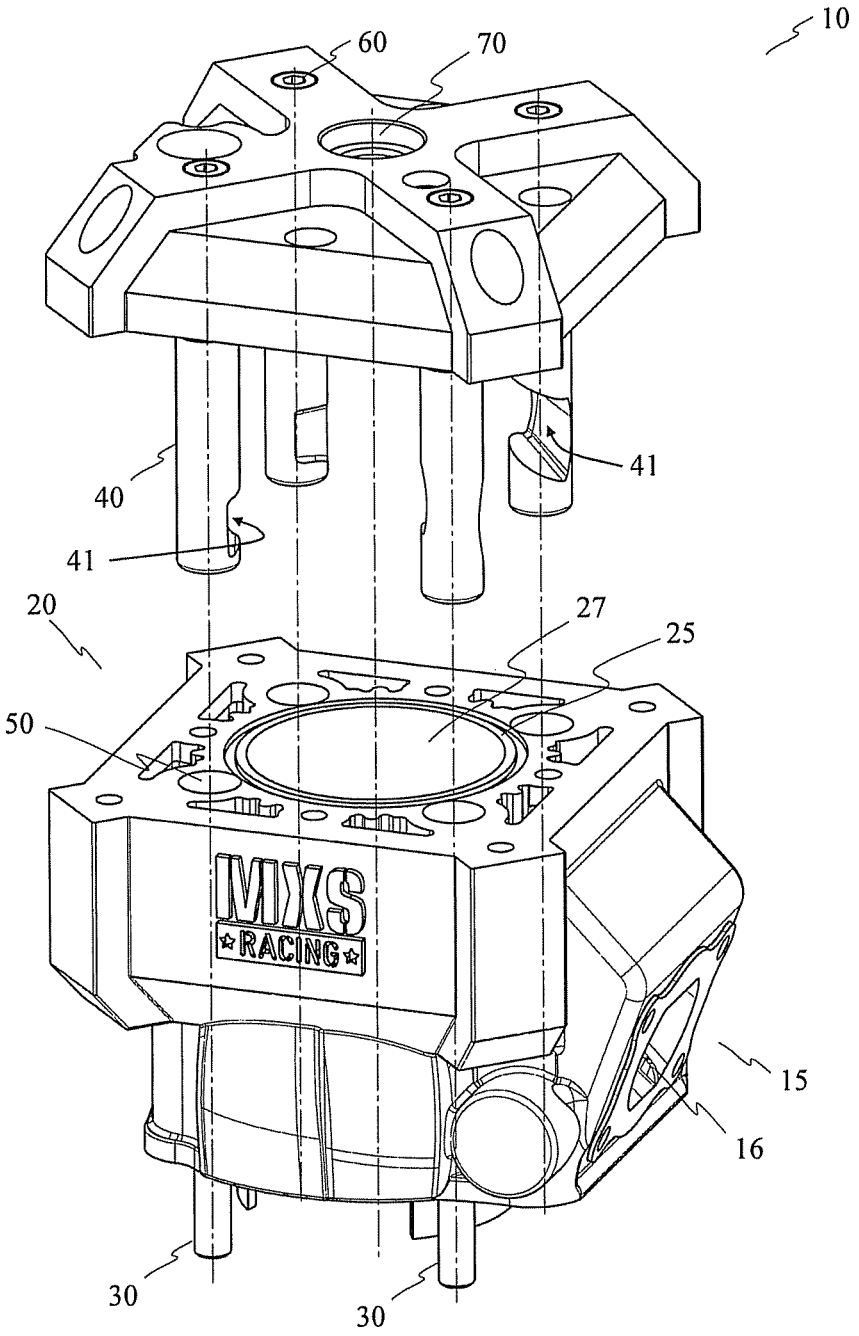
FIG. 1 shows a cylinder according to an embodiment of the present invention with a cylinder head in an exploded view.

Reference will now be made in detail to the present embodiments of the present invention, examples of which are illustrated in the accompanying drawings, wherein like reference numerals refer to the like elements throughout. The embodiments are described below in order to explain aspects of the present invention by referring to the figures.

FIG. 1 shows a cylinder block 20 according to an example of the present invention for a two-stroke engine with a cylinder head 10 in an exploded view. The cylinder block 20 comprises a bore, in which a piston is guided to be able to move up and downwards. The cylinder block 20 is closed at one end by a cylinder head 10. The other end is attached to a crankcase (not shown here), wherein lower attachment screws 30 are provided for attaching the cylinder block in existing stud bolt bores of the crankcase. The crankcase comprises a pivot-mounted crankshaft which is driven by the piston moving up and down.

Figure 2:
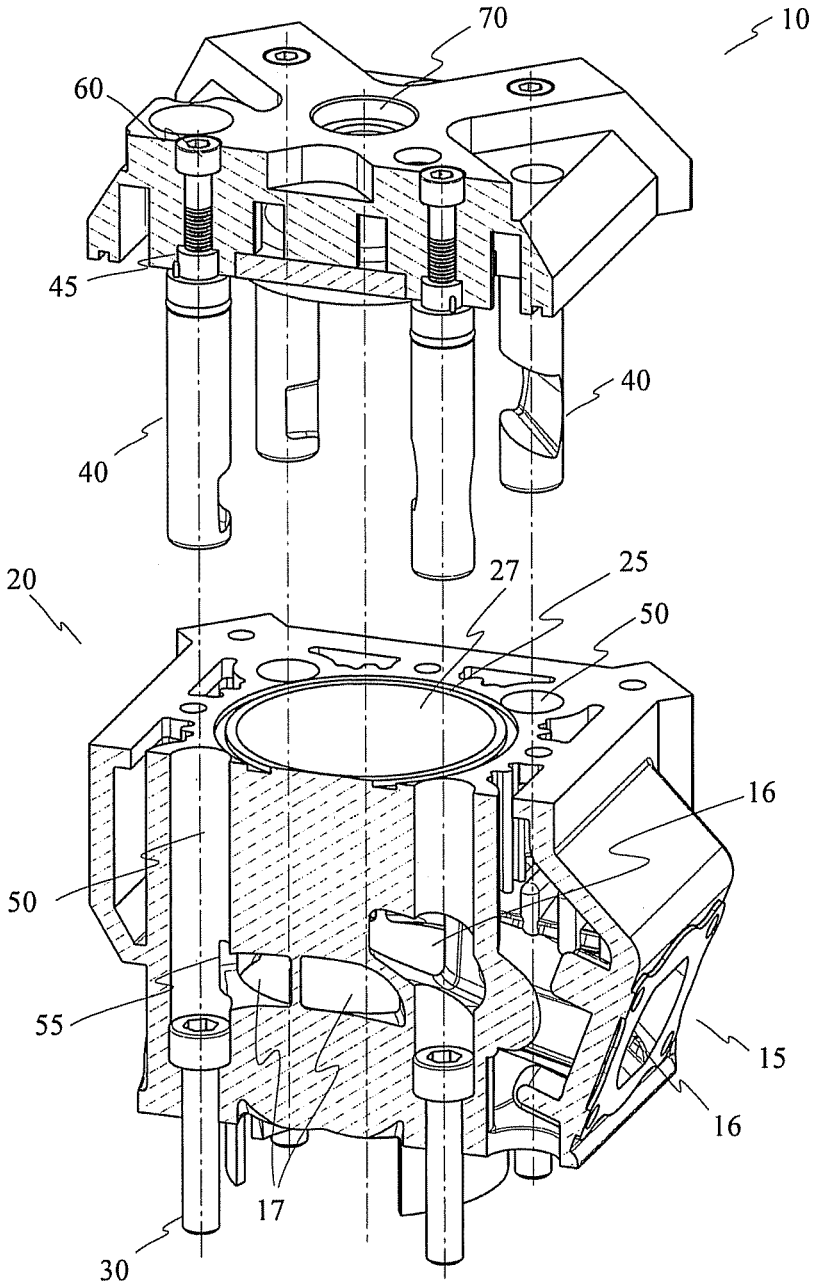
FIG. 2 is a sectional view of the cylinder according to an embodiment of the present invention with the cylinder head according to FIG. 1.

The cylinder block 20 comprises a combustion chamber 27 being limited and formed by a cylinder running surface 25, the cylinder head 10 and the piston, which is connected with the crankcase via transfer ports 17 (see FIG. 2). The combustion chamber 27, furthermore, comprises an outlet 15 or an outlet port 16 in order to discharge the gases from combustion. The openings of the transfer ports 17 or of the outlet ports 16 in a cylinder wall are opened and closed by the piston moving up and down according to the position of the piston. The embodiment of the transfer ports will be discussed in detail later.

Pins 40 are arranged at the cylinder head 10, wherein the pins 40 are attached to the cylinder head 10 by means of upper attachment screws 60. In the embodiment of the cylinder according to an aspect of the present invention shown here, four pins 40 are provided at the cylinder head 10. There may be also more or less than four pins 40. Furthermore, the pins 40 can also be attached to the cylinder head 10 by means of different fixing means.

The cylinder block 20 comprises bores 50 parallel to the longitudinal axis of the cylinder block 20, which are provided as holder for the pins 40 when the cylinder head 10 is mounted on the cylinder block 20. Before mounting the cylinder head 10 with the attached pins 40 on the cylinder block 20, lower attachment screws 30 are inserted in the bores 50, which at least partially protrude at the bottom side of the cylinder block 20, and which are provided for attaching the cylinder block 20 to the crankcase of the two-stroke engine.

The pins 40, being formed in one part in the embodiment according to FIG. 1, comprise rim side cut-outs 41, which are formed in such a way that they close the openings at the wall side in the transfer ports 17 or in the outlet ports 16, as explained in detail with reference to the following figures.

Furthermore, the cylinder head 10 comprises an opening 70 as a holder for a spark plug (not shown here).

Preferably, but not required, the bores 50 are shaped cylindrically; preferably, the pins 40 are also shaped cylindrically and have the same diameter as the bores 50.

FIG. 2 shows the cylinder block 20 and the cylinder head 10 of FIG. 1 as an exploded view and as a sectional view of the two front bores 50. It can be seen, that the pins 40 at the cylinder head 10 are attached to the cylinder head 10 by means of the upper attachment screws 60. The pins 40 each comprise a lock against rotation 43, as explained in detail with reference to FIG. 6. The cylinder head 10 comprises cut-outs at the bottom side, into which an upper section of the pins 40 is inserted. The cut-outs comprise a groove corresponding with the lock against rotation 43. The lock against rotation 43 and the corresponding groove ensure that the pins 40 can only be attached to the cylinder head 10 in a predetermined position.

Before mounting the cylinder head 10 with the attached pins 40 on the cylinder block 20, the lower attachment screws 30 are inserted in the bores 50, which at least partially protrude at the bottom side of the cylinder block 20, and which are provided for attaching the cylinder block 20 to the crankcase of the two-stroke engine. The lower attachment screws 30 can be adapted in order to attach the cylinder block 20 to the existing stud bolt holes of the crankcase. In a preferred embodiment of the invention, the arrangement of the bores 50 is selected in such a way that the longitudinal axis of the bores 50 corresponds with the longitudinal axis of the stud bolt holes, respectively. However, the invention is not limited thereto.

No possible transfer ports or outlet ports must be considered when making the bores 50 according to an aspect of the present invention, since openings in the ports generated by the making of the bores 50 will again be closed by the pins 40. This way it becomes possible that a cylinder can be provided for different types of engines, wherein only the bores 50 have to be adapted to the respective type of engine and wherein only the suitable pins 40 have to be provided for the respective type of engine for closing the openings in the ports. This way, it is avoided that different cylinder blocks have to be manufactured for different types of engine. According to an aspect of the present invention, the additional work and expense for adapting a cylinder to different types of engines is limited to the corresponding arrangement of the bores 50 and to providing the corresponding pins 40.

As can be seen from FIG. 2, the bores 50 at least partially run through the transfer ports 17 and/or through the outlet ports 16. According to this arrangement of the bores 50, the transfer ports 17 and/or the outlet ports 16 are at least partially drilled, so that an opening at the wall side 55 is generated in the transfer ports 17 and/or in the outlet ports 16. These openings at the wall side 55 are again closed by mounting the cylinder head 10 with the pins 40 attached to it, wherein the original shape of the ports is restored after closing the openings at the wall side 55.

For this purpose, it is necessary to provide the respective cut-outs 41 of the individual pins 40, which surface or which surfaces correspond to the original surface of the wall, which refers to the portion of the surface of the wall prior to being penetrated by the bore 50 of the ports in the area of the openings at the wall side 55. Since the openings at the wall side 55 arising from the making of the bores 50 are again closed by the pins 40, the position and the course of the transfer ports 17 or of the outlet ports 16 do not have to be considered when making the bores 50. Particularly, when drafting the transfer ports 17 or the outlet ports 16, the course of the bores 50 does not need to be considered, since the openings at the wall side 55 arising from the making of the bores 50 can, if need be, be closed again by the pins 40. Based on this, there are additional possibilities particularly for the design of the transfer ports 17, since they are no longer limited to stud bolts known from the prior art.

FIG. 2 shows two transfer ports 17, wherein the left transfer port 17 is partially drilled by a bore 50. Furthermore, FIG. 2 shows an outlet port 16, which is also at least partially drilled by a bore 50.

Figure 3:
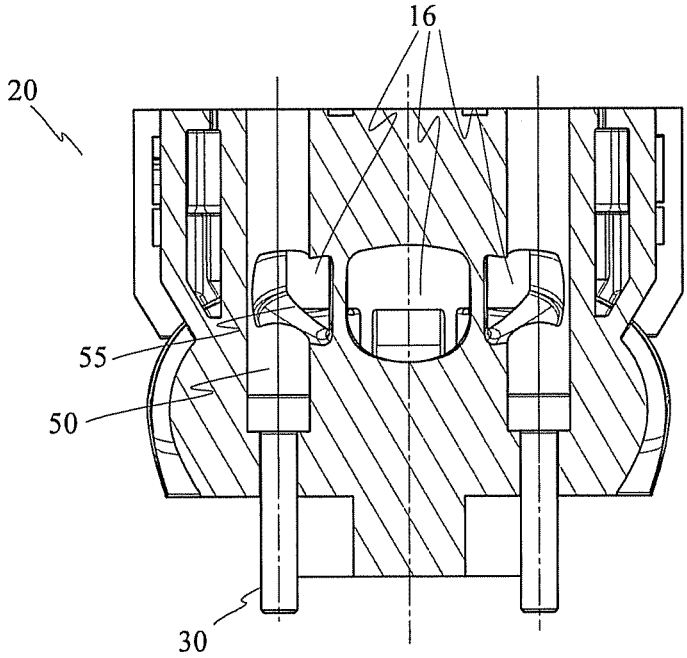
FIG. 3 shows a cylinder block without a cylinder head according to an embodiment of the present invention in a sectional view, wherein the section goes through outlet ports.

FIG. 3 shows a cylinder block 20 without a cylinder head according to an aspect of the present invention in a sectional view, wherein the section goes parallel to the longitudinal axis of the cylinder block 20 and through the outlet ports 16. As is particularly evident here, the left outlet port 16 and the right outlet port 16 are each at least partially drilled by a bore 50, so that the left and the right outlet 16 port each comprise an opening at the wall side 55. These openings at the wall side are closed by the pins 40 attached to the cylinder head 10, as is shown in FIG. 4.

Figure 4:
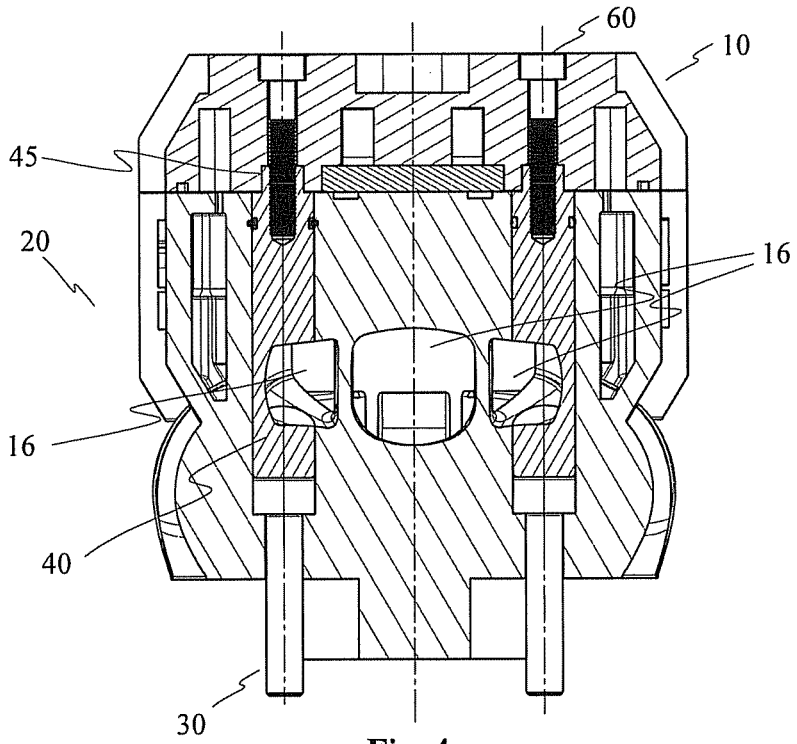
FIG. 4 shows a cylinder block with a cylinder head according to an embodiment of the present invention with a cylinder head in a sectional view, wherein the section goes through the outlet ports.

FIG. 4 shows the section through the cylinder block 20 of FIG. 3, wherein it furthermore shows a cylinder head 10 with the pins 40 arranged at it, mounted on the cylinder block 20. It is particularly evident from FIG. 4 that the openings at the wall side 55 in the left and in the right outlet port 16 are each closed by the corresponding rim side cut-out 41 of the pins 40, so that an original surface of the original wall, which refers to the portion of the surface of the wall prior to being penetrated by the bore 50 of the respective outlet ports is restored after inserting the pins 40 into the bores 50 by a portion of the pin 40. As already explained with reference to FIG. 1, the pins 40 are attached to the cylinder head 10 using upper attachment screws. Furthermore, the pins 40 are shaped in such a way that they can be inserted into the bores 50 in a form-locked manner.

Figure 5A:
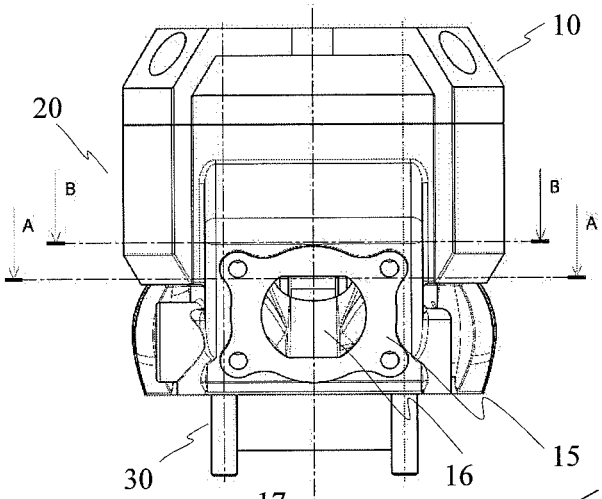
FIG. 5A is a side view of a cylinder according to an embodiment of the present invention with a cylinder head as well and FIGS. 5B and 5C are two sectional views of the cylinder along axes A-A and B-B, respectively, each perpendicular to the longitudinal axis of the cylinder.
Figure 5B:
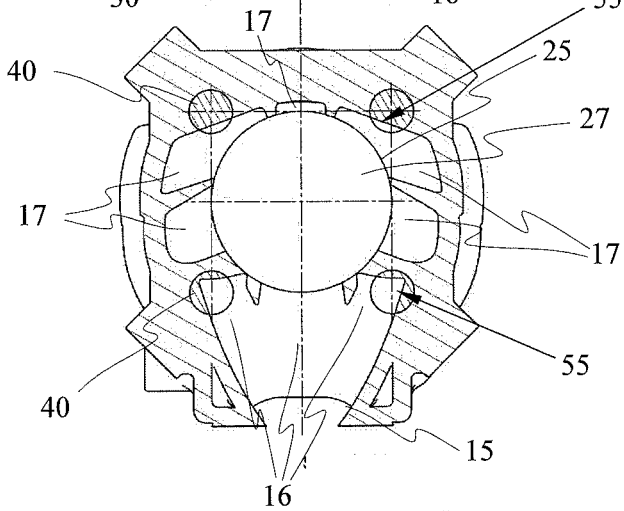

FIG. 5A shows a side view of a cylinder block 20 according to an aspect of the present invention with a cylinder head 10 mounted on it as well FIGS. 5A and 5B show two sectional views of the cylinder block 20 along axes A-A and B-B, respectively, wherein each section is perpendicular to the cylinder axis of the cylinder block 20.

As can be seen from the section A-A shown in FIG. 5B, the wall side openings 55 at least partially penetrate the transfer ports 17 and at least partially the left and the right outlet port 16. The openings at the wall side 55 of the ports 17, 16 being generated by this are each closed by a pin 40.

Figure 5C:
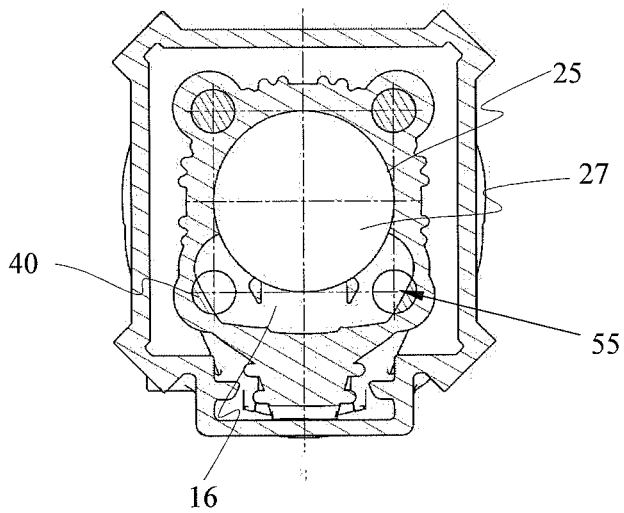

As can be seen from the section B-B in FIG. 5C, the bores 50 at least partially penetrate the left and the right outlet port 16, wherein the openings at the wall side 55 being generated by this can also be closed again by the pins 40. Thus, FIG. 5B shows the openings 55 in the outlet ports 16 and the transfer ports 17, whereas FIG. 5C shows the openings 55 only in the outlet ports 16.

Figure 6:
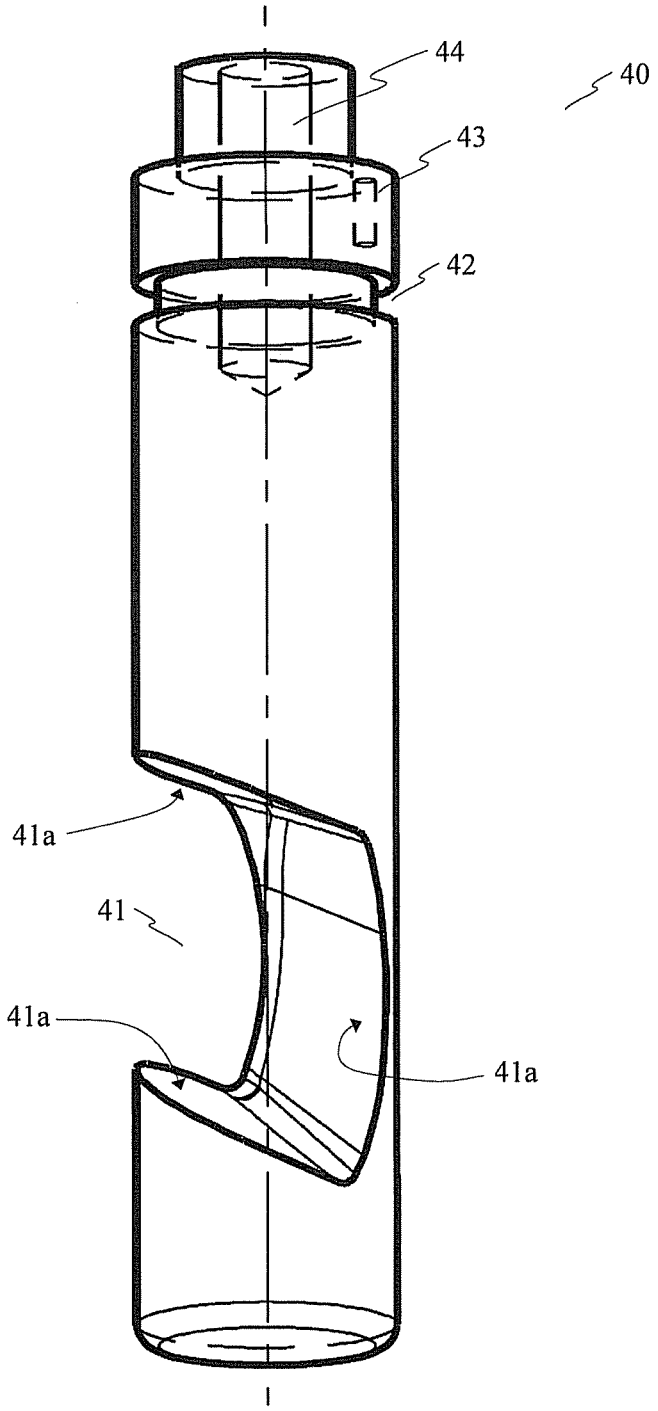
FIG. 6 is a perspective view of a pin according to an embodiment of the present invention.

FIG. 6 shows a detailed view of a pin 40 according to an aspect of the present invention.

The pin 40 is substantially shaped cylindrically and comprises a rim side cut-out 41. The boundary surfaces 41*a* defining the cut-out 41 substantially correspond to the original surface of the wall of the outlet port or of the transfer port in the area of the opening at the wall side 55. This way, the original surface of the original wall, which refers to a portion of a surface of the wall of the outlet port 16, if the transfer port 17 prior to being penetrated by the bore 50, of the transfer port 17 or of the outlet port 16 is restored when inserting the pin 40 into the bore 50. It is important that the pin 40 can be substantially arranged in the bore 50 in a form-locked manner.

The pin 40 can comprise a circumferential groove 42 in the upper area or in the area of the upper end, into which a, for example, sealing ring can be arranged.

Furthermore, the pin 40 comprises a lock against rotation 43 at the upper end, which can be, for example, formed as a needle of a needle roller bearing. The lock against rotation 43 is provided to attach the pin 40 to the cylinder head 10 in a predetermined position, wherein a cut-out is provided at the cylinder head 10 corresponding with the lock against rotation 43, into which the lock against rotation 43 can be arranged. This way it is ensured already when attaching the pins 40 to the cylinder head 10, the pins 40 are attached in that position, which is required for closing the openings at the side wall 55 in the ports 17,16.

As a matter of course, the rim side cut-out 41 may have a different shape than the one shown in FIG. 6. The exact shape of the rim side cut-out 41 depends on the position of the respective port 16, 17 and the way how the bore 50 penetrates the respective port 16,17.

A pin 40 may also comprise several cut-outs 41, for example, when two transfer ports are arranged one upon the other or side by side and the bore 50 drills both transfer ports 17.

FIG. 1 to FIG. 6 each show a cylinder block 20 according to an aspect of the present invention, wherein the openings at the wall side 55 in the transfer ports 17 or in the outlet ports 16 are closed using a pin 40 formed in one part.

Figure 7:
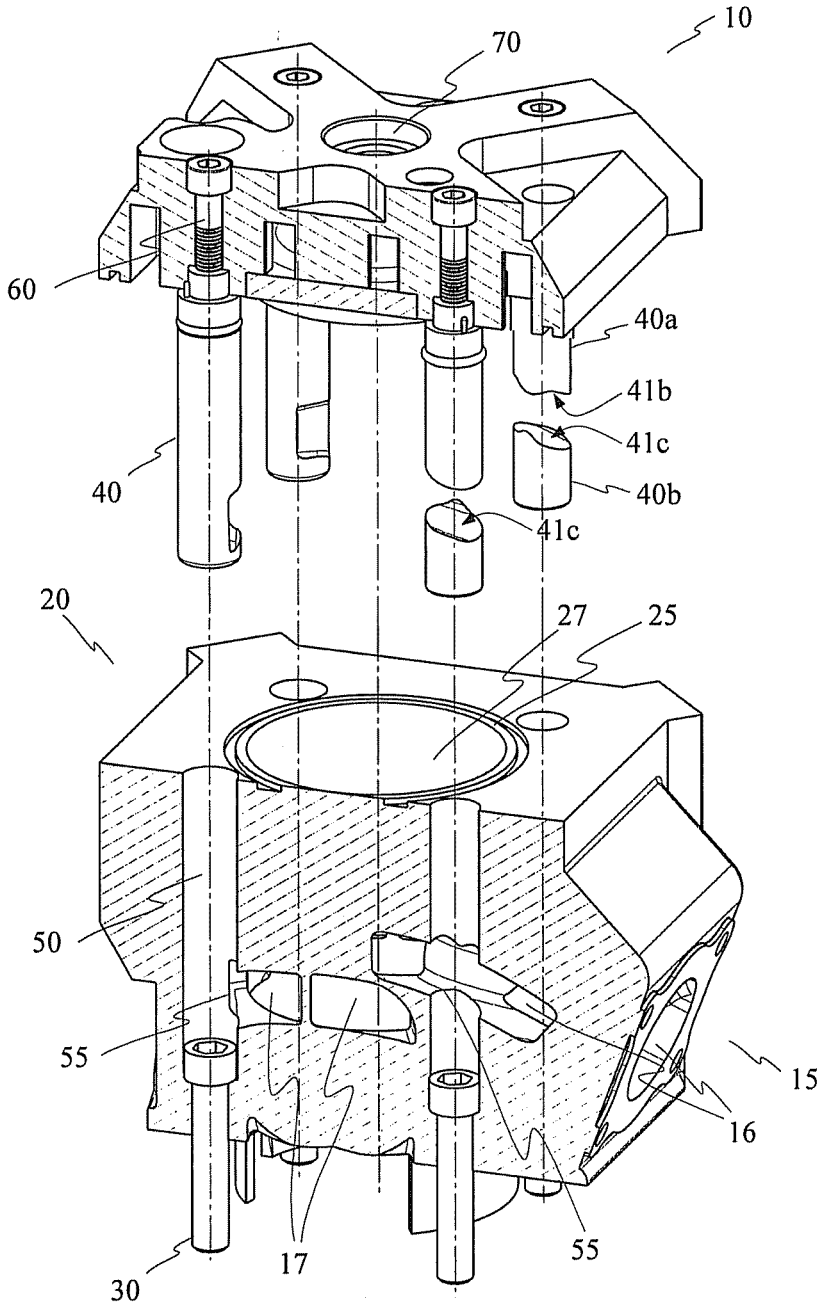
FIG. 7 shows a cylinder according to an embodiment of the present invention with a cylinder head in an exploded view with two pins formed in one part and two pins formed in two parts.

FIG. 7 shows an embodiment of the invention, wherein the pins 40 are formed in two parts. An embodiment of the pins 40 formed in two parts is required when a bore 50 completely penetrates a port, i.e., when the bore 50 runs through the port in such a way that the bore 50 is completely within the port. In this case, two openings at the wall side 55 are generated in the port using the bore 50, which are closed by a pin 40 formed in two parts, wherein an upper section 40*a* of the pin 40 closes the upper opening and a lower section 40*b* of the pin 40 closes the lower opening.

The upper section 40*a* of the pin 40 comprises a lower boundary surface 41*b*, which substantially corresponds to the original surface of the upper opening at the wall side of the port 55. Correspondingly, the lower section 40*b* of the pin 40 comprises an upper boundary surface 41*c*, which substantially corresponds to the original surface of the lower opening at the wall side 55 of the port.

In FIG. 7, the bore 50 is completely divided by the outlet ports 16, whereas the bores 50 in the area of the transfer ports 17 are only partially divided by them. Pins 40 formed in two parts are provided for the completely divided bores 50 in the area of the outlet ports 16 in order to close the two openings at the side wall 55 in the outlet ports 16. Initially, the lower part 40*b* of the pin 40 is inserted into the bore 50 and is then fixed. The upper part 40*a* of the pin 40 is attached to the cylinder head 10 using the upper attachment screws 60. When mounting the cylinder head 10 onto the cylinder block 20, the pins 40 formed in one part as well as the upper parts 40*a* of the pins formed in two parts are inserted into the respective bores 50.

As a matter of course, the lower parts 40*b* of the pins 40 formed in two parts may also comprise a lock against rotation, ensuring that the lower parts 40*b* remain in the bore 50 in the desired position. Furthermore, the lock against rotation can be designed in such a way that the lower part 40*b* of the pin 40 formed in two parts is prevented from moving freely along the bore hole.

Figure 8:
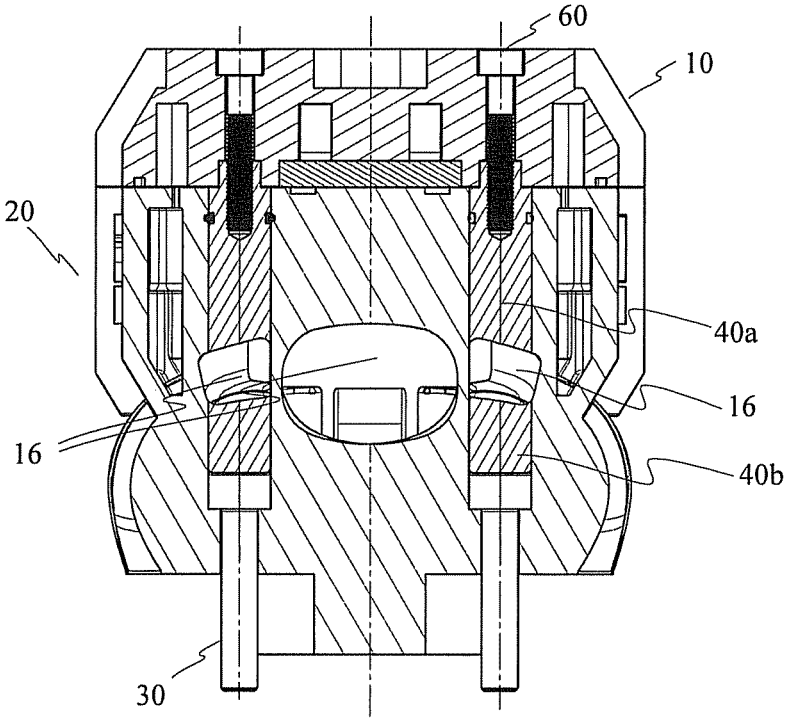
FIG. 8 shows a cylinder according to an embodiment of the present invention with a cylinder head in a sectional view, wherein the section goes through the two pins formed in two parts.

FIG. 8 shows a cylinder block 20 according to an aspect of the present invention in a sectional view with a cylinder head 10, wherein the section is parallel to the longitudinal axis of the cylinder block 20 and through the outlet ports 16. It is particularly evident that the left and the right outlet ports 16 completely penetrate the bore 50 so that preferably a pin 40 formed in two parts with a lower part 40*b* and an upper part 40*a* is provided in order to close the two openings at the wall side in the two outlet ports 16.

It is possible to use a cylinder block for different types of engines using the cylinder block according to an aspect of the present invention or using the fixing device according to an aspect of the present invention for attaching a cylinder block to a crankcase of a two-stroke engine, since the position of the transfer ports or of the outlet ports does not need to be considered when attaching the cylinder block to the respective crankcase. The transfer ports and/or outlet ports can be drilled at will, since the openings at the wall side in the respective ports resulting from the bore are closed again according to an aspect of the present invention using the inserted pins.

A further advantage of the invention is that the position of possibly existing stud bolts does not need to be considered when designing the transfer ports and/or the outlet ports, since lower attachment screws 30 are provided instead of the stud bolts, which are inserted into the original stud bolt holes. As a result, there are more possibilities with regard to the design or the embodiment of different ports, so that even more powerful cylinder blocks can be manufactured, since the size and the shape especially of the transfer ports and of the outlet ports is not limited by the stud bolts.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A two-stroke engine including a crankcase, the two-stroke engine comprising:

a cylinder block;

a combustion chamber with an outlet port, wherein the combustion chamber is formed in a cylinder running surface; and a cylinder head, which closes the cylinder block at an end of the combustion chamber, wherein:

at least one transfer port is formed in the cylinder in order to connect an interior space of the crankcase with the combustion chamber, the cylinder block comprises at least one axial bore, at least partially penetrated in a wall of the outlet port and/or of the transfer port, so that the bore at least partially forms an opening at the wall side in the outlet port and/or in the transfer port, and a pin is in the at least one bore and closes the at least one opening at the wall side wherein a portion of a surface of the wall of the outlet port and/or of the transfer port penetrated by the bore is substantially restored in the area of the opening at the wall side with a portion of the pin, the pin is substantially cylindrical and comprises a rim side cut-out, and a surface of the rim side cut-out substantially corresponds to the portion of the surface of the wall of the outlet port and/or of the transfer port in the area of the opening at the wall side.

2. The two-stroke engine according to claim 1, wherein:

the pin comprises upper and lower parts, the upper part facing the cylinder head and the lower part facing the crankcase, a lower boundary surface of the upper part of the pin closes a first opening at the wall side of the outlet port and/or of the transfer port, and an upper boundary surface of the lower part of the pin closes a second opening at the wall side of the outlet port and/or of the transfer port.

3. The two-stroke engine according to claim 1, wherein a lower section of the bore facing the crankcase has a smaller diameter than an upper section of the bore, and a lower fixing mechanism is in the lower section of the bore and attaches the cylinder block to the crankcase.

4. The two-stroke engine according to claim 1, wherein an upper part of the pin is attached to the cylinder head using an upper fixing mechanism.

5. The two-stroke engine according to claim 4, wherein the upper end of the upper part of the pin comprises a blind bore which holds the upper fixing mechanism.

6. The two-stroke engine according to claim 1, wherein the pin comprises at least one radial cut-out which holds an o-ring.

7. The two-stroke engine according to claim 1, wherein an upper section of the pin at least partially extends into a deepening at the bottom side of the cylinder head corresponding with the upper section of the pin.

8. The two-stroke engine according to claim 7, wherein the upper section of the pin comprises a lock against rotation which extends into a cut-out in the deepening, the cut-out corresponding with the lock against rotation.

9. The two-stroke engine according to claim 8, wherein the lock against rotation comprises a needle of a needle roller bearing.

* * * * *